United States Patent [19]

Velezis

[11] Patent Number: 5,072,537

[45] Date of Patent: Dec. 17, 1991

[54] MAGAZINE CATCH ASSEMBLY

[76] Inventor: George A. Velezis, 175 Skyline Dr., Middlebury, Conn. 06762

[21] Appl. No.: 624,414

[22] Filed: Dec. 7, 1990

[51] Int. Cl.[5] ..... F41A 9/25
[52] U.S. Cl. ..... 42/18
[58] Field of Search ..... 42/18, 22, 6

[56] References Cited

U.S. PATENT DOCUMENTS

| | | | |
|---|---|---|---|
| 747,777 | 12/1903 | Ross | 42/18 |
| 1,533,966 | 4/1925 | Browning | 42/18 |
| 2,305,033 | 12/1942 | Roemer | 42/18 |

FOREIGN PATENT DOCUMENTS

| | | | |
|---|---|---|---|
| 60039 | 1/1891 | Fed. Rep. of Germany | 42/18 |

*Primary Examiner*—Charles T. Jordan

*Attorney, Agent, or Firm*—McCormick, Paulding & Huber

[57] ABSTRACT

A magazine catch assembly for a firearm includes a pair of opposing magazine catches supported for pivotal movement toward and away from each other between magazine retaining and releasing positions. In the magazine retaining position the magazine catches cooperate with a part of a magazine to releasably secure the magazine within a magazine well. A manually operable actuating member disposed between the catches and biased toward a first position corresponding to the magazine retaining position of the catches is moveable to a latching position corresponding to the releasing position of the catches in response to movement to its second position whereby the magazine is free to drop from the magazine well. Movement of a magazine out of the magazine well resets the magazine catches in magazine retaining position.

18 Claims, 3 Drawing Sheets

MAGAZINE CATCH ASSEMBLY

BACKGROUND OF THE INVENTION

This invention relates in general to firearms and deals more specifically with an improved magazine catch assembly for a firearm.

The magazine catch assembly of the present invention is suitable for use with firearms of all types, but particularly adapted for use with an assault rifle or shotgun where ability to rapidly reload is of paramount importance. Much of the time required for reloading a magazine loaded long gun is spent in releasing and/or manually removing the empty magazine from the gun.

It is the general aim of the present invention to provide an improved magazine catch assembly for a firearm to minimize time required for reloading.

SUMMARY OF THE INVENTION

The present invention is concerned with improvements in a firearm having means defining a magazine well and a magazine catch assembly for engaging an associated part of a magazine received within the well to releasably retain the magazine therein. In accordance with the present invention the improved magazine catch assembly includes a magazine catch supported on the firearm for movement between magazine retaining and magazine releasing positions. The magazine catch in its retaining position engages an associated part of a magazine such as aforesaid disposed within the magazine well. In its magazine releasing position the magazine catch is out of engagement with the part. A manually operable catch actuating member supported for movement between first and second positions respectively corresponding to the retaining and releasing positions of the catch is biased toward its first position. The assembly further includes latching means for releasably securing the actuating member in a latching position in response to movement of the actuating member to its second position whereby to release the magazine allowing it to drop from the well.

DETAILED DESCRIPTION OF PREFERRED EMBODIMENT

Figure 1:
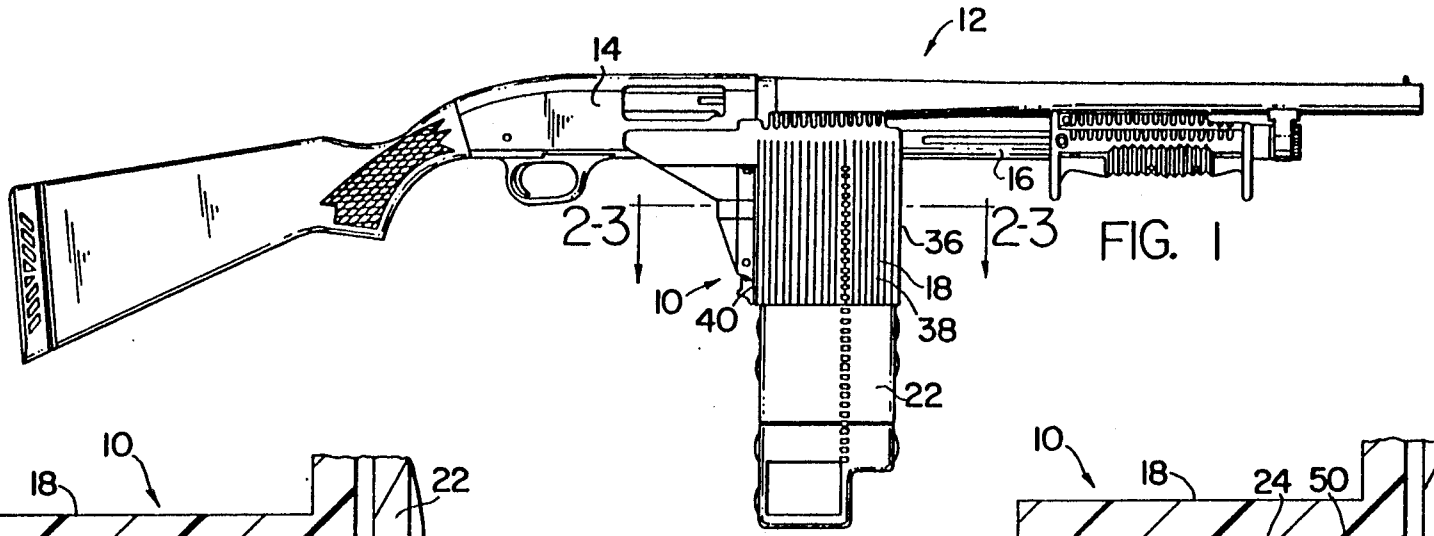
FIG. 1 is a side elevational view of a firearm having a magazine catch assembly embodying the present invention.

Turning now to the drawings, a magazine catch assembly embodying the present invention is indicated generally by the reference numeral 10. The illustrated magazine catch assembly 10 is hereinafter described with reference to a firearm or pump action shotgun indicated generally at 12 and oriented as shown in FIG. 1.

The shotgun 12 has a receiver 14 and a magazine tube 16 which projects in a forward direction from the receiver and communicates with the interior of the receiver. A magazine housing or shroud 18 fastened to and depending from the receiver defines a magazine well 20 for receiving a box magazine, indicated by the numeral 22. The magazine shroud 18 also supports the magazine catch assembly 10 which cooperates with a part of a magazine, such as the magazine 22, to releasably retain the magazine within the magazine well 20. A plurality of rounds of ammunition or shotgun shells contained within the magazine 22, but not shown, are successively fed from the magazine into the magazine tube 16 through an opening in the wall of the magazine tube and advanced to loading position within the receiver by an associated plunger mechanism (not shown) contained within the magazine tube in response to operation of the pump action, all of which may be generally conventional.

The magazine catch assembly of the present invention essentially comprises at least one magazine catch, but preferably, and as shown, the illustrated catch assembly 10 includes a pair of magazine catches 24,24 supported within the magazine shroud 18 for releasably retaining a box magazine, such as the magazine 22, within the magazine well 20 and a manually operable actuating member, indicated generally at 26, for moving the catches 24,24 to and maintaining the catches in a releasing position to release the magazine from the magazine well, all of which will be hereinafter more fully discussed.

The box magazine 22 used in practicing the invention may be of a conventional type and has a generally rectangular cross-section. A magazine retaining part, indicated generally at 28 and which cooperates with the magazine catch assembly 10, is mounted in fixed position on the rear wall of the magazine 22 and projects rearwardly from it. The retaining member 28 is spaced downwardly from the upper end of the magazine and has a generally horizontally disposed downwardly facing abutment surface 30. The upper end portion of the retaining member 28 is at least partially defined by a plurality of cam surfaces which include a forwardly and upwardly inclined rear cam surface 32 and a pair of laterally spaced apart upwardly and inwardly inclined side cam surfaces 34,34, as best shown in FIGS. 2-5.

Considering now the magazine catch assembly 10 in further detail and as oriented in the drawings, the magazine well may be formed in an integral part of a gun frame. However, as previously noted, the magazine well 20 is defined by the magazine shroud 18 which also supports the magazine catch assembly 10. The magazine shroud is preferably molded from durable plastic material, bolted to the receiver 14, and has a front wall 36, a pair of sidewalls 38,38 (one shown), and a rear wall 40 which cooperate to define the generally rectangular downwardly open magazine well 20. The magazine catch assembly is housed in an integral rearward extension of the magazine shroud 18 which defines a vertically elongate downwardly open recess 42 for receiving the actuating member 26. A vertically disposed and downwardly open elongate slot 44 formed in the rear wall 40 communicates with the magazine well 20 and the recess 42 for receiving the magazine retaining part 28 of an associated magazine 22 disposed within the magazine well 20, as it appears in FIGS. 4 and 5. The upper end portion of the rear wall 40 above the slot 44 defines a vertically disposed rearwardly facing surface 45 and an arcuately rearwardly and upwardly inclined cam surface 46 contiguous to the surface 45, for a purpose which will be hereinafter further evident. A rear central portion of the shroud is laterally enlarged and defines a generally laterally extending slot 47 which opens into the recess 42.

Figure 2:
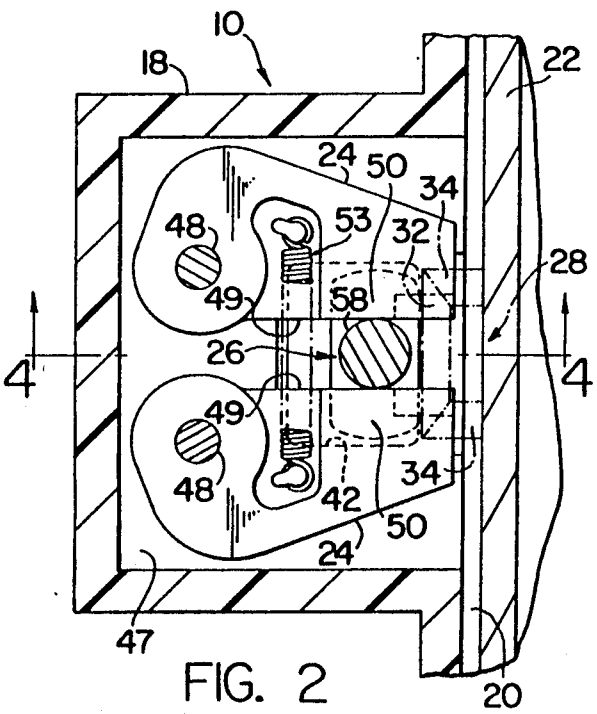
FIG. 2 is a fragmentary sectional view taken generally along the line 2—2 of FIG. 1 and shows the magazine catches in magazine retaining position.
Figure 6:
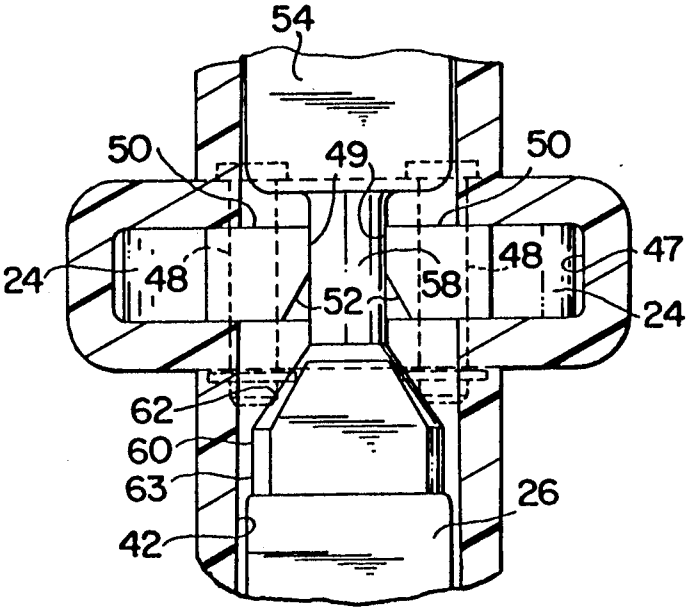
FIG. 6 is a sectional view taken along the line 6—6 of FIG. 4.

The magazine catches 24,24 are supported on the magazine shroud within the slot 47 for pivotal movement about laterally spaced apart and vertically extending axes defined by pivot pins 48,48 which pass through the magazine shroud 18 substantially as shown. Each magazine catch 24 has a free end which extends into the recess 42, as shown in FIG. 2, and includes a vertically disposed inner surface 49, a substantially horizontally disposed and upwardly facing bearing surface 50 and an upwardly and inwardly inclined cam surface 52, as best shown in FIG. 6. A spring 53 connected to and acting between the magazine catches 24,24 biases the catches inwardly toward each other and toward the magazine retaining position shown in FIG. 2, as will be hereinafter further discussed.

The catch actuating member 26 has a vertically elongate body which includes a generally rectangular upper end part 54 and an elongate generally rectangular lower part 56. The upper end part and lower end part of the actuating member are connected by a generally cylindrical neck part 58 and a shoulder part 60 below the neck part. The shoulder part 60 is partially defined by an upwardly converging parti-conical surface portion 62 which terminates at the lower end of the neck part and further defined by a vertically disposed parti-cylindrical surface portion 63 below the conical surface portion 62.

Figure 3:
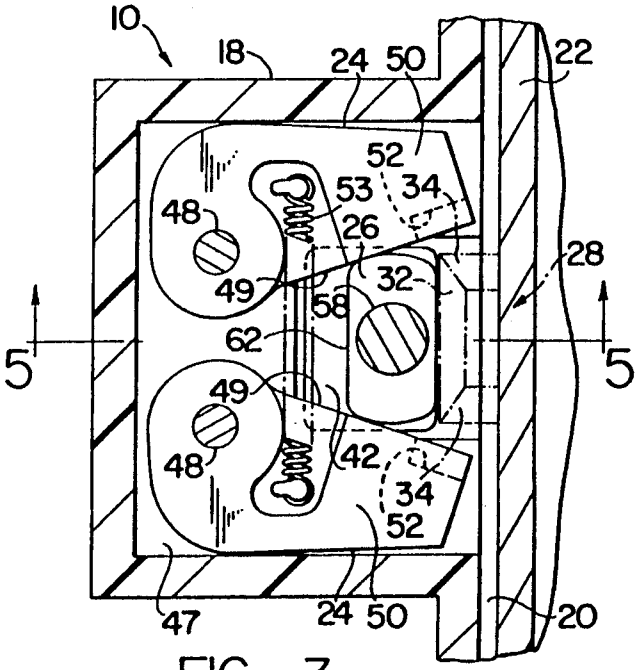
FIG. 3 is similar to FIG. 2 but shows the magazine catches in releasing position.
Figure 4:
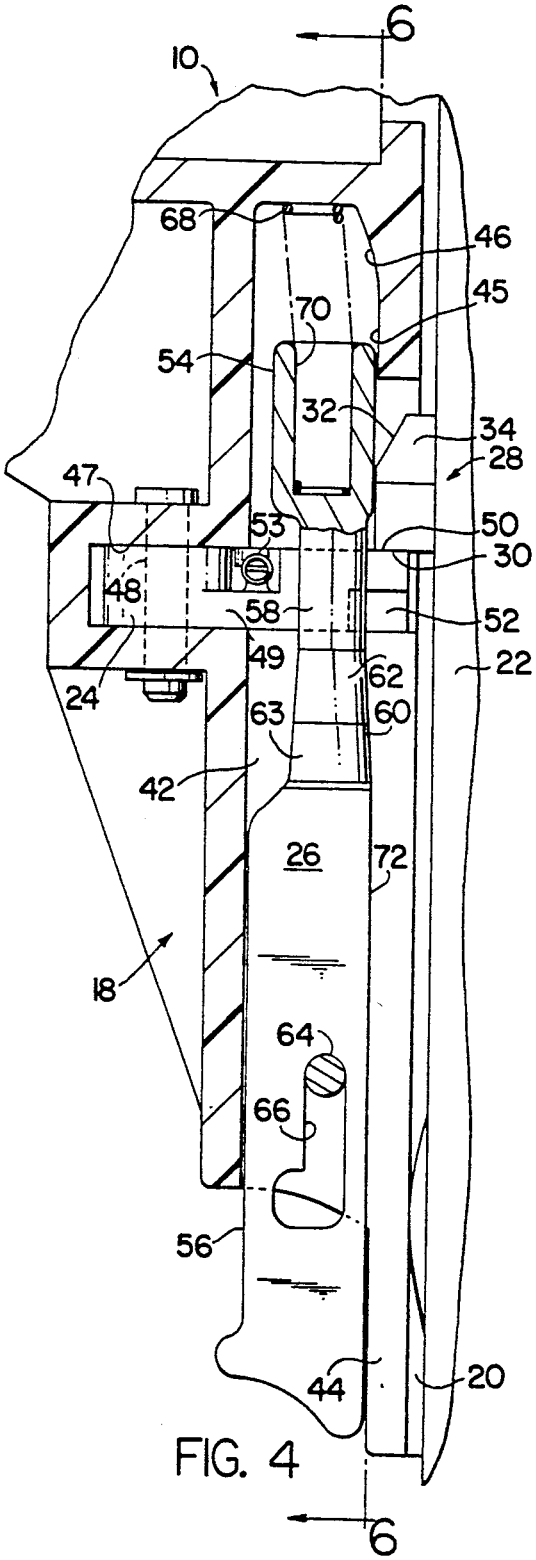
FIG. 4 is a fragmentary sectional view taken generally along the line 4—4 of FIG. 2.
Figure 5:
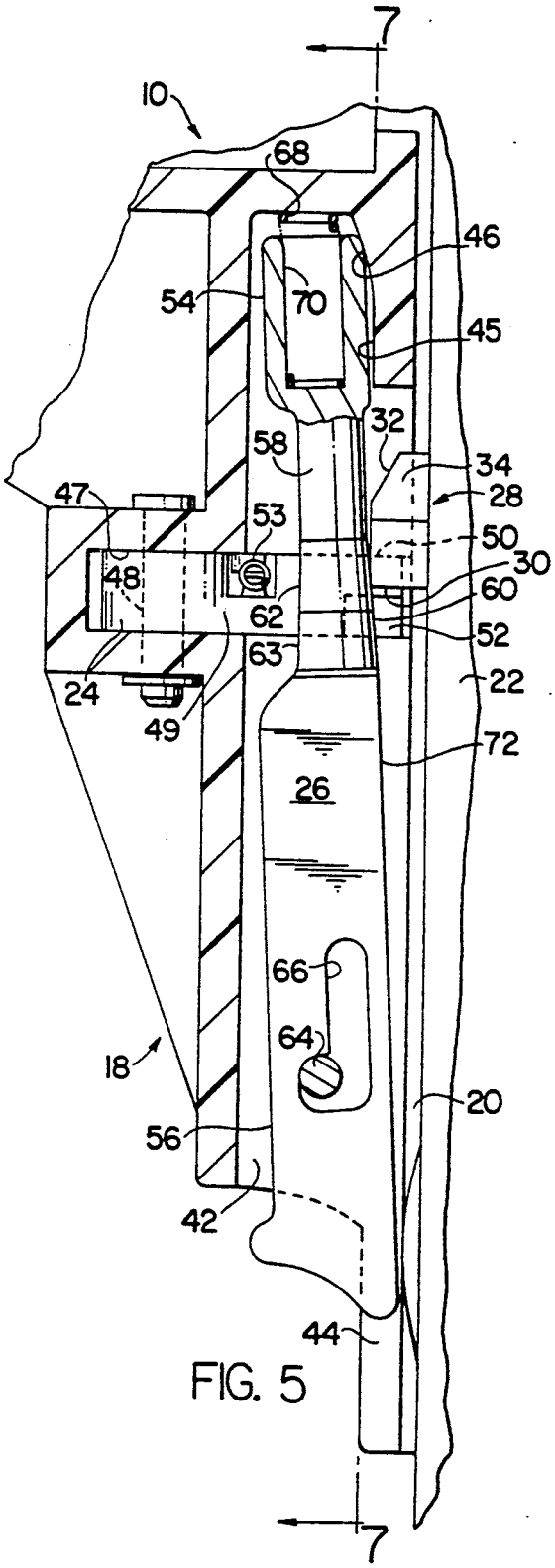
FIG. 5 is a fragmentary sectional view taken generally along the line 5—5 of FIG. 3.
Figure 7:
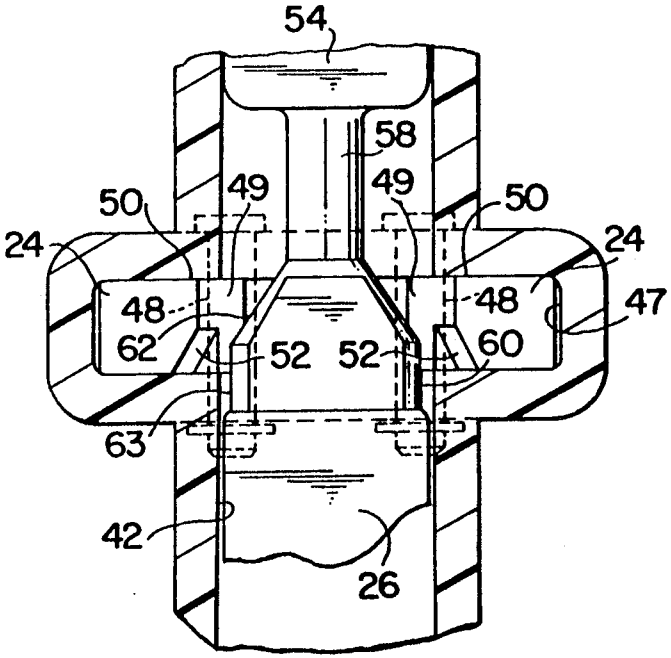
FIG. 7 is a fragmentary sectional view taken along the line 7—7 of FIG. 5.

The actuating member 26 is supported and retained within the recess 42 by a laterally disposed pin 64 carried by the magazine shroud 18 and extending through a generally L-shaped slot 66 formed in the lower part 56. The L-shaped slot 66 has a vertically extending portion and a horizontally rearwardly extending lower end portion as shown in FIGS. 4 and 5. A spring 68 disposed within a spring receiving recess 70 in the upper end part 54 acts between the magazine shroud 18 and the actuating member to bias the actuating member 26 in downward direction. The upper end of the spring 68 bears against the upper end wall of the recess 42 and is disposed slightly rearwardly of the lower end of the spring which causes the spring 68 to exert a slight forwardly directed biasing force upon the upper end of the actuating member 26, as best shown in FIG. 4. The actuating member 26 is supported within the recess 42 for movement between a first position, shown in FIG. 4, corresponding to the retaining position of the catches 24,24, shown in FIG. 2, and a second position, shown in FIG. 5, corresponding to a releasing position of the catches 24,24, shown in FIG. 3.

When the magazine well 20 is empty the actuating member 26 is normally in its first position (FIG. 4) and the catches 24,24 are in magazine retaining position (FIG. 2), being biased into engagement with the laterally reduced neck portion 58 by the catch spring 53. When a magazine, such as the magazine 22, is inserted into the magazine well 20 through the opening in the lower end of the magazine shroud 18 its magazine holding member 28 is received within the slot 44. As the magazine 22 is moved upwardly within the magazine well 20 the side cam surfaces 34,34 on the magazine holding member 28 engage the cam surfaces 52,52 on the catches 24,24 causing the catches to pivot outwardly away from each other toward the magazine releasing position of FIG. 3 wherein the magazine holding member 28 is free to pass between the latches 24,24 and move to a position above the latches wherein it is fully inserted into the magazine well 20. As the magazine retaining part 28 attains a position above the catches 24,24 the catches return to magazine retaining position (FIG. 2) in response to the biasing force of the catch spring 53. The downwardly facing abutment surface 30 on the magazine retaining part engages the upwardly facing bearing surfaces 50,50 on the magazine catches whereby the magazine 22 is releasably retained within the well 20.

The magazine 22 is released from the magazine well 20 by manually moving the actuating member 26 upwardly within the magazine shroud 18 from its first position of FIG. 4 to its second position of FIG. 5. During the initial portion of its upward travel from its first position toward its second position the actuating member 26 moves along a substantially rectilinear path guided by co-engagement of upper end part 54 and the surface 45 and cooperation of the pin 64 and the slot 66. Further upwardly movement of the actuating member results in engagement of the upper end part 54 with the arcuate cam surface 46 causing slight pivotal movement of the actuating member 26 in counterclockwise direction about the pin 64 from its position of FIG. 4. The parti-conical surface portion 62 engages the catches 24,24 and pivots the catches laterally outward in opposite directions toward releasing position, shown in FIG. 3. Ultimately, the vertically disposed parti-cylindrical surface portion 63 is interposed between the catches 24,24, as shown in FIG. 3, and maintains the catches in magazine releasing position wherein the bearing surfaces 50,50 on the two catches 24,24 are disposed out of vertical alignment with the abutment surface 30 on the magazine retaining part 28.

As the actuating member 26 approaches its second position shown in FIG. 5, the inner surfaces 49,49 of the catches exert a forwardly directed biasing force on the actuating member 26 at a position intermediate the pin 64 and the upper end of the actuating member resulting in counterclockwise rotation of the member 26 about its upper end part 54 on a fulcrum provided by the surface 46. This counterclockwise rotation causes the actuating member 26 to snap into its latching position wherein the pin 64 is engaged within the horizontally disposed lower leg of the L-shaped slot 66 (FIG. 5). Thereafter, the downwardly directed biasing force of the spring 68 retains the actuating member 26 in its latching position. Thus, the pin 64 cooperates with the horizontally disposed lower portion of the L-shaped slot 66 as shown in FIG. 5 to provide a latching means for securing the actuating member 26 in a second position corresponding to the releasing position of the catches 24,24.

While the actuating member 26 remains in its latching position the catches 24,24 remain in a magazine releasing position and the magazine retaining member 28 is free to move downwardly between the catches 24,24. However, when the actuating member 26 is in its latching position its frontal surface, indicated at 72, is downwardly and forwardly inclined and in the path of downward movement of the retaining member 28. The force of gravity acting upon the empty magazine 22 may be sufficient to cause it to fall from the magazine well 20. As the magazine 22 moves downwardly and out of the magazine well the magazine retaining part 28 engages the downwardly and forwardly inclined surface 72 of the actuating member 26 to pivot the actuating member in clockwise direction about its upper end part 54 from its latching of FIG. 5 releasing the pin 64 from the horizontally disposed lower end portion of the L-shaped slot 66 as the magazine retaining part moves downwardly relative the frontal surface of the actuating member 26. When the slot 66 is vertically aligned with the pin 64 the downwardly directed biasing force exerted upon the actuating member 26 by the spring 68 causes the actuating member to snap to its first position of FIG. 4, thereby allowing the empty magazine to fall freely from the magazine well 20. In the event that the magazine 22 does not readily fall from the magazine well 20 due to its own weight, a slight shaking of the firearm will usually be sufficient to cause the empty magazine to drop out of the firearm. Thus, release of the magazine from the magazine well occurs quite rapidly.

In the event that the actuating member 26 is moved to its latching position (FIG. 5) when the magazine well is empty the biasing force of the spring 68 will be sufficient to maintain the actuating member in its latching position. However, when another magazine is inserted into the magazine well 20 the cam surface 30 on the magazine retaining member will engage the lower end portion of the actuating member 26 and cam the actuating member in a clockwise direction about its upper end part relative to the fulcrum provided by the surface 46 thereby releasing the actuating member 26 from its latching position and causing it to snap to its first position (FIG. 4). Thus, the magazine will be retained in the magazine well by the magazine catch assembly 10 when it is fully inserted into the magazine well 20.

A skilled gun handler can manipulate the magazine actuating member 26 with a sweeping hand motion to release a magazine from the magazine well. Thus, an empty magazine may be released with a continuous hand motion while the gun handler is holding the gun in one hand and reaching for another magazine with his other hand or while holding another magazine in ready position in the other hand for insertion into the magazine well. Thus, reloading may be accomplished without lost motion and in minimal time.

I claim:

1. A firearm having magazine housing means defining a magazine well for receiving a magazine therein, and a catch assembly supported on the firearm for releasably retaining a magazine in the magazine well and including at least one magazine catch supported for movement between magazine retaining and magazine releasing positions, said magazine catch in its magazine retaining position being engagable with an associated part of a magazine such as aforesaid disposed within the magazine well to secure the magazine in the well, said magazine catch in its magazine releasing position being out of engagement with the part, and a manually operable actuating member for moving said magazine catch to its magazine releasing position, said actuating member being supported for movement between a first position corresponding to said magazine retaining position and a second position corresponding to said magazine releasing position, and latching means for releasably securing said actuating member in a latching position wherein said magazine catch is in said magazine releasing position in response to movement of the actuating member to said second position.

2. A firearm as set forth in claim 1 wherein said catch assembly includes a pair of magazine catches supported for movement toward each other and to said magazine retaining position and away from each other and to said magazine releasing position.

3. A firearm as set forth in claim 1 wherein said latching means comprises means for biasing said actuating member toward said latching position in response to movement of said actuating member to said second position.

4. A firearm as set forth in claim 3 wherein said magazine catch comprises said means for biasing said actuating member toward said latching position.

5. A firearm as set forth in claim 4 wherein said actuating member is pivotally moveable from said second position to said latching position.

6. A firearm as set forth in claim 5 wherein said actuating member is pivotally moveable about a fulcrum defined by a wall of said magazine well.

7. A firearm as set forth in claim 1 wherein said catch assembly includes a pair of magazine catches supported for pivotal movement toward and away from each other.

8. A firearm as set forth in claim 7 wherein said actuating member is supported for movement between said first and second positions in a direction generally parallel to the pivotal axes of said magazine catches.

9. A firearm as set forth in claim 1 including first biasing means for urging said magazine catch toward said magazine retaining position.

10. A firearm as set forth in claim 9 including second biasing means for urging said actuating member toward its first position.

11. A firearm as set forth in claim 1 wherein said latching means comprises a slot in said actuating member and a pin supported in fixed position on said firearm and disposed within said slot.

12. A firearm as set forth in claim 11 wherein said slot comprises a generally L-shaped slot.

13. A firearm as set forth in claim 1 including means for releasing said actuating member from said latching position in response to movement of a magazine out of said magazine well.

14. A firearm as set forth in claim 13 wherein said means for releasing said actuating member comprises co-engaging surfaces on said actuating member and the associated part of a magazine within said magazine well.

15. A firearm having magazine housing means defining a downwardly open magazine well for receiving a magazine therein, a magazine catch assembly disposed rearwardly of said magazine well having catch means for releasably retaining a magazine in said magazine well and including a pair of magazine catches supported for pivotal movement about generally vertically extending axes toward each other and to a magazine retaining position wherein said catches engage an associated part of a magazine receiving within said well and away from each other and to a magazine releasing position wherein said magazine catches are out of engagement with the associated part, first biasing means for urging said magazine catches toward said magazine retaining position, a manually operable catch actuating member disposed between said magazine catches, means supporting said catch actuating member for generally vertical movement between a first position corresponding to said retaining position and a second position corresponding to said releasing position of said magazine catches and including a pin mounted in fixed position relative to said firearm and extending through an L-shaped slot in said catch actuating member, said slot having a generally vertically extending leg and a generally horizontally leg extending rearwardly from the lower end of said generally vertically extending leg, second bias means for urging said catch actuating member downwardly toward its first position, and biasing means for urging said actuating member to a latching position corresponding to the releasing position of said catches in response to upwardly movement of said actuating member to said second position, said pin being disposed within said generally horizontal leg of said slot when said catch actuating member is in said latching position.

16. A firearm as set forth in claim 15 wherein said catches comprise said biasing means for urging said catch actuating member to said latching position.

17. A firearm as set forth in claim 16 wherein said catch actuating member is pivotally moveable about a generally horizontally disposed axis to said latching position.

18. A firearm as set forth in claim 17 wherein said catch actuating member is pivotally moveable about a fulcrum defined by a wall of said magazine well.

* * * * *